US012559813B2

(12) United States Patent
Kim et al.

(10) Patent No.: US 12,559,813 B2
(45) Date of Patent: Feb. 24, 2026

(54) THIN STEEL PLATE HAVING EXCELLENT LOW-TEMPERATURE TOUGHNESS AND CTOD PROPERTIES, AND METHOD FOR MANUFACTURING SAME

(71) Applicant: POSCO, Pohang-si (KR)

(72) Inventors: Woo-Gyeom Kim, Pohang-si (KR); Sang-Ho Kim, Pohang-si (KR); Ki-Hyun Bang, Pohang-si (KR)

(73) Assignee: POSCO, Pohang-si (KR)

( * ) Notice: Subject to any disclaimer, the term of this patent is extended or adjusted under 35 U.S.C. 154(b) by 617 days.

(21) Appl. No.: 17/632,364

(22) PCT Filed: Aug. 21, 2020

(86) PCT No.: PCT/KR2020/011178
§ 371 (c)(1),
(2) Date: Feb. 2, 2022

(87) PCT Pub. No.: WO2021/040332
PCT Pub. Date: Mar. 4, 2021

(65) Prior Publication Data

US 2022/0282352 A1 Sep. 8, 2022

(30) Foreign Application Priority Data

Aug. 23, 2019 (KR) ..... 10-2019-0104016

(51) Int. Cl.
*C22C 38/00* (2006.01)
*C21D 1/60* (2006.01)
(Continued)

(52) U.S. Cl.
CPC ..... *C21D 9/46* (2013.01); *C21D 1/60* (2013.01); *C21D 6/005* (2013.01); *C21D 6/008* (2013.01);
(Continued)

(58) Field of Classification Search
CPC . C21D 9/46; C21D 1/60; C21D 6/005; C21D 6/008; C21D 8/0205; C21D 8/0226;
(Continued)

(56) References Cited

U.S. PATENT DOCUMENTS 6,669,789 B1 * 12/2003 Edelman ..... C21C 7/064 420/128
11,268,175 B2 * 3/2022 Um ..... C22C 38/46
(Continued)

FOREIGN PATENT DOCUMENTS

EP 3561115 A1 10/2019
EP 3696287 A1 8/2020
(Continued)

OTHER PUBLICATIONS

International Search Report dated Nov. 24, 2020 issued in International Patent Application No. PCT/KR2020/011178 (with English translation).
(Continued)

*Primary Examiner* — John A Hevey
(74) *Attorney, Agent, or Firm* — Morgan Lewis & Bockius LLP

(57) ABSTRACT

The present invention relates to structural steel that can be desirably used in offshore structures and the like, more specifically, to a thin steel plate having excellent low-temperature toughness and CTOD properties, and to a method for manufacturing the same.

4 Claims, 1 Drawing Sheet

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.
CPC ..... *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/005* (2013.01)

(58) Field of Classification Search
CPC ..... C21D 2211/005; C21D 1/19; C21D 1/84; C21D 6/001; C21D 8/0263; C21D 1/02; C21D 1/613; C21D 11/005; C22C 38/001; C22C 38/002; C22C 38/02; C22C 38/04; C22C 38/06; C22C 38/08; C22C 38/12; C22C 38/14; C22C 38/16
See application file for complete search history.

(56) References Cited

U.S. PATENT DOCUMENTS

| | | | | |
|---|---|---|---|---|
| 11,453,933 | B2 * | 9/2022 | Um | C22C 38/58 |
| 2018/0363111 | A1 * | 12/2018 | Um | C22C 38/46 |
| 2020/0080179 | A1 * | 3/2020 | Um | C22C 38/48 |
| 2020/0087765 | A1 * | 3/2020 | Um | C22C 38/58 |
| 2020/0109461 | A1 | 4/2020 | Lee et al. | |
| 2020/0255920 | A1 | 8/2020 | Jung | |

FOREIGN PATENT DOCUMENTS

| | | | | |
|---|---|---|---|---|
| EP | 3730640 | A1 | 10/2020 | |
| JP | H10-265852 | A | 10/1998 | |
| JP | 2015-224374 | A | 12/2015 | |
| KR | 10-2010-0066757 | A | 6/2010 | |
| KR | 10-2010-0067509 | A | 6/2010 | |
| KR | 10-2012-00097160 | A | 9/2012 | |
| KR | 10-2013-0107170 | A | 10/2013 | |
| KR | 10-2015-0076696 | A | 7/2015 | |
| KR | 10-2017-0071639 | A | 6/2017 | |
| KR | 10-2018-0073090 | A | 7/2018 | |
| KR | 10-2018-0074470 | A | 7/2018 | |
| KR | 10-2019-0035422 | A | 4/2019 | |
| KR | 10-2019-0077196 | A | 7/2019 | |
| WO | WO-2017105109 | A1 * | 6/2017 | C21D 6/004 |
| WO | 2018/117727 | A1 | 6/2018 | |
| WO | WO-2018117766 | A1 * | 6/2018 | C21D 1/18 |
| WO | WO-2018117767 | A1 * | 6/2018 | C21D 1/18 |
| WO | 2019/074236 | A1 | 4/2019 | |
| WO | 2019/088762 | A1 | 5/2019 | |
| WO | 2019/124890 | A1 | 6/2019 | |

OTHER PUBLICATIONS

Chinese Office Action dated May 7, 2022 issued in Chinese Patent Application No. 202080057361.3 (with English translation).
Japanese Office Action dated Jul. 11, 2023 issued in Japanese Patent Application No. 2022-505529.
Extended European Search Report dated Aug. 14, 2023 issued in European Patent Application No. 20858438.3.

* cited by examiner

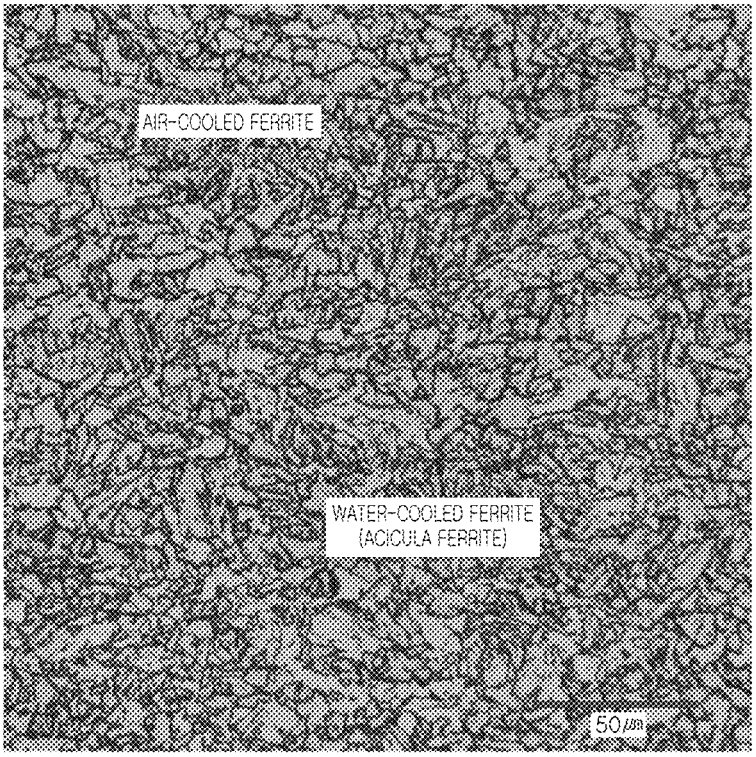
AIR-COOLED FERRITE
WATER-COOLED FERRITE
(ACICULA FERRITE)
50μm

THIN STEEL PLATE HAVING EXCELLENT LOW-TEMPERATURE TOUGHNESS AND CTOD PROPERTIES, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/011178, filed on Aug. 21, 2020, which in turn claims the benefit of Korean Application No. 10-2019-0104016, filed on Aug. 23, 2019, the entire disclosures of which applications are incorporated by reference herein.

TECHNICAL FIELD

The present disclosure relates to a structural steel which may be preferably applied to offshore structures and the like, and more particularly, to a thin steel plate having excellent low-temperature toughness and CTOD properties and a manufacturing method thereof.

BACKGROUND ART

Development of ocean energy and resources are extending to the deep sea, cold regions, polar regions, and the like, and floating-type offshore structures such as SPAR, tension leg platform (TLP), and floating processing storage and offloading (FPSO) are being actively constructed.

In addition, as development in land space becomes increasingly difficult, attempts are being made to build maritime-type structures in hard-to-reach areas such as deserts, rainforests, and permafrost areas, using floating structures.

Meanwhile, for protection of the marine environment, accidents causing damage to offshore structures are almost unacceptable, and thus, absolute safety is required.

In this respect, a steel material used for offshore structures and the like is being subjected to high-strengthening and post-materialization, but since usability of a thin material comes to the fore, it becomes important to secure high strength and low-temperature toughness of the thin material in terms of stability.

In particular, since it is expected that a demand for thin materials will be increased in the floating structures, it is necessary to improve the high strength and the low-temperature toughness of thin materials.

(Patent Document 1) Korean Patent Laid-Open Publication No. 10-2010-0067509

DISCLOSURE

Technical Problem

An aspect of the present disclosure is to provide a thin steel plate having excellent low-temperature toughness and CTOD properties, and a manufacturing method thereof.

A use of the steel material intended in the present disclosure is not necessarily limited to offshore structures, and the steel material may be sufficiently used in shipbuilding, general structures, or the like.

An object of the present disclosure is not limited to the above description. The object of the present disclosure will be understood from the overall content of the present specification, and a person skilled in the art to which the present disclosure pertains will understand additional objects of the present disclosure without difficulty.

Technical Solution

According to an aspect of the present disclosure, a thin steel plate having excellent low-temperature toughness and CTOD properties includes, by weight: 0.05 to 0.1% of carbon (C), 0.05 to 0.3% of silicon (Si), 1.0 to 2.0% of manganese (Mn), 0.005 to 0.04% of aluminum (Sol. Al), 0.005 to 0.03% of niobium (Nb), 0.005 to 0.02% of titanium (Ti), 0.05 to 0.4% of copper (Cu), 0.3 to 1.0% of nickel (Ni), 0.001 to 0.08% of nitrogen (N), 0.01% or less of phosphorus (P), and 0.003% or less of sulfur (S), with a balance of Fe and other unavoidable impurities, wherein the thin steel plate includes acicular ferrite having an area fraction of 30 to 50% (water-cooled ferrite) and polygonal ferrite having an area fraction of 50 to 70% (air-cooled ferrite) as a microstructure, and has a thickness of 8 to 30 mm.

According to another aspect of the present disclosure, a manufacturing method of a thin steel plate having excellent low-temperature toughness and CTOD properties includes: heating a steel slab satisfying the alloy composition described above to 1200° C. or higher; rough rolling the heated steel slab at 1000° C. or higher; after the rough rolling, finish-hot-rolling the steel slab at a temperature equivalent to or higher than Ar3 to manufacture a hot-rolled steel plate; air-cooling the hot-rolled steel plate; and after the air cooling, cooling the hot-rolled steel plate at a cooling speed of 10 to 30° C./s, wherein the cooling is water cooling, and starts in a temperature range of 660 to 690° C. and ends in a temperature range of 550 to 590° C., and the steel plate has a thickness of 8 to 30 mm.

Advantageous Effects

As set forth above, according to an exemplary embodiment in the present disclosure, a thin steel plate having a thickness of 8 to 30 mm, which has excellent cryogenic toughness with high strength and excellent CTOD fatigue properties may be provided.

The thin steel plate of the present disclosure may be applied as a steel material for offshore structures of fixed type or floating type offshore structures which is expected to demand a shock insurance of about −40° C., and also, may be advantageously applied as a steel for shipbuilding and general structures requiring low-temperature toughness.

DESCRIPTION OF DRAWINGS

FIG. 1 is a photograph of a microstructure of a thin steel plate according to an exemplary embodiment in the present disclosure.

BEST MODE FOR INVENTION

In developing a steel material for offshore structures up to date, an attempt has been made mainly to secure the strength and the low-temperature toughness of a thick material having a specific thickness or more. However, there were few attempts to apply a thin material as a steel material for offshore structures.

The inventors of the present disclosure expected that the use of a thin material as a steel material for offshore structures and the like would be increased in the future, and intensively studied for obtaining a thin material having physical properties appropriate for being used as a steel material for offshore structures.

In particular, the present inventors confirmed that it is important to control the composition and contents of alloy components and control the structure of a parent metal in order to improve the strength and the low-temperature toughness (impact toughness) of the thin material. Accordingly, the present disclosure has a technical significance in providing a thin steel plate having a yield strength of 460 MPa or more and an impact toughness at −40° C. of 50 J or more by optimizing an alloy component system and manufacturing conditions.

Hereinafter, the present disclosure will be described in detail.

The thin steel plate having excellent low-temperature toughness and CTOD properties according to an exemplary embodiment in the present disclosure may include, by weight: 0.05 to 0.1% of carbon (C), 0.05 to 0.3% of silicon (Si), 1.0 to 2.0% of manganese (Mn), 0.005 to 0.04% of aluminum (Sol. Al), 0.005 to 0.03% of niobium (Nb), 0.005 to 0.02% of titanium (Ti), 0.05 to 0.4% of copper (Cu), 0.3 to 1.0% of nickel (Ni), 0.001 to 0.08% of nitrogen (N), 0.01% or less of phosphorus (P), and 0.003% or less of sulfur (S).

Hereinafter, the reason that the alloy composition of the steel plate provided in the present disclosure is limited as described above will be described in detail.

Meanwhile, unless otherwise particularly stated in the present disclosure, the content of each element is by weight % and the ratios of the structure are by area.

Carbon (C): 0.05 to 0.1%

Carbon (C) is an element advantageous for causing solid solution strengthening and being combined with niobium (Nb) and the like in the steel to form precipitates such as carbides to secure tensile strength.

When the content of C is more than 0.1%, formation of an island martensite (MA, martensite-austenite constituent) phase may be promoted and pearlite is produced, so that impact and fatigue properties of a steel material are deteriorated at low temperature. However, when the content of C is less than 0.05%, a target level of strength may not be secured.

Therefore, C may be included at 0.05 to 0.1%, more advantageously at 0.06% or more, and more advantageously at 0.07% or more. Meanwhile, a more preferred upper limit of C may be 0.09%.

Silicon (Si): 0.05 to 0.3%

Silicon (Si) serves to deoxidize molten steel with aluminum, and in the present disclosure, silicon is an important element for securing impact and fatigue properties at a low temperature with strength improvement.

In order to sufficiently secure the effect described above, it is preferred to include 0.05% or more of Si, but when the content is greater than 0.3%, diffusion of C is hindered to promote formation of an MA phase.

Therefore, Si may be included at 0.05 to 0.3%.

Manganese (Mn): 1.0 to 2.0%

Manganese (Mn) is an element having a large effect of strength improvement by solid solution strengthening, and may be added in an amount of 1.0% or more. However, when the content is excessive to be more than 2.0%, a MnS inclusion is formed and segregated in the center of a steel material to cause deterioration of toughness.

Therefore, Mn may be included at 1.0 to 2.0%, and more advantageously at 1.3% or more. Meanwhile, a more preferred upper limit of Mn may be 1.8%.

Aluminum (Sol. Al): 0.005 to 0.04%

Aluminum (Sol. Al) is a main deoxidizer of steel and may be included at 0.005% or more. However, when the content is greater than 0.04%, an $Al_2O_3$ inclusion is formed in a large amount and the size is increased to cause deterioration of low-temperature toughness of steel. In addition, coarse AlN may be formed to deteriorate surface quality of steel and production of a MA phase is promoted in a parent material and a weld heat affected zone to deteriorate low-temperature toughness and low-temperature fatigue properties.

Therefore, Al may be included at 0.005 to 0.04%.

Niobium (Nb): 0.005 to 0.03%

Niobium (Nb) is an element which is effective for refining the structure by suppressing recrystallization during rolling or cooling by solid solution or precipitation as carbides and is advantageous for strength improvement.

In order to sufficiently obtain the above effect, niobium may be added in an amount of 0.005% or more, but when the content is greater than 0.03%, due to its affinity with C, C is concentrated, for example, C is gathered by formation of NbC to promote formation of a MA phase, and thus, toughness and fracture properties may be deteriorated at low temperature.

Therefore, Nb may be included at 0.005 to 0.03%.

Titanium (Ti): 0.005 to 0.02%

Titanium (Ti) is an element which is combined with oxygen (O) or nitrogen (N) in steel to form precipitates. These precipitates suppress coarsening and contribute to refining of structure, and thus, are advantageous for improving toughness.

In order to sufficiently obtain the effect described above, 0.005% or more Ti may be added, but when the content is greater than 0.02%, the precipitates are coarsened as they are to cause fracture.

Therefore, Ti may be included at 0.005 to 0.02%.

Copper (Cu): 0.05 to 0.4%

Copper (Cu) is advantageous for improving strength by solid solution strengthening and precipitation strengthening without significantly impairing impact properties.

When the content of Cu is less than 0.05%, it is difficult to sufficiently obtain the effect described above, and when the content is greater than 0.4%, cracks may occur in the surface of a steel plate by Cu thermal shock.

Therefore, Cu may be included at 0.05 to 0.4%.

Nickel (Ni): 0.3 to 1.0%

Nickel (Ni) is an element for improving both strength and toughness of steel. In order to sufficiently obtain the effect, 0.3% or more nickel may be included, but when the content is greater than 1.0%, hardenability is increased to promote formation of a MA phase, thereby impairing impact toughness and CTOD properties of steel.

Therefore, Ni may be included at 0.3 to 1.0%.

Nitrogen (N): 0.001 to 0.008%

Nitrogen (N) is an element which forms precipitates with Ti, Nb, Al, and the like to refine an austenite structure during reheating to help to improve strength and toughness.

In order to sufficiently obtain the effect described above, it is preferred to add 0.001% or more of nitrogen. However, when the content is greater than 0.008%, surface cracks are caused at a high temperature, precipitates are formed, and remaining N is present as an atom state to decrease toughness.

Therefore, N may be included at 0.001 to 0.008%.

Phosphorus (P): 0.01% or less

Phosphorus (P) is an element causing grain boundary segregation and may cause embrittlement of steel. Therefore, the content of P should be controlled as low as possible.

In the present disclosure, there is no difficulty in securing the physical properties to be intended even when up to 0.01% of P is included, and thus, the content of P may be limited to 0.01% or less. However, considering the unavoidably added level, 0% may be excluded.

Sulfur (S): 0.003% or less

Sulfur (S) is mainly combined with Mn in steel to form a MnS inclusion, causing low-temperature toughness to be deteriorated.

Therefore, in order to secure the low-temperature toughness and the low-temperature fatigue properties intended in the present disclosure, the content of S should be controlled to be as low as possible, and preferably may be limited to 0.003% or less. However, considering the unavoidably added level, 0% may be excluded.

The remaining component of the present disclosure is iron (Fe). However, since in the common manufacturing process, unintended impurities may be inevitably incorporated from raw materials or the surrounding environment, they may not be excluded. Since these impurities are known to any person skilled in the common manufacturing process, the overall contents thereof are not particularly mentioned in the present specification.

As an example, the steel material of the present disclosure may include molybdenum (Mo) or chromium (Cr) at less than 0.05%, respectively.

The thin steel plate of the present disclosure having the alloy component system described above includes a ferrite phase as a microstructure, and preferably may include water-cooled ferrite and air-cooled ferrite in combination.

Meanwhile, the thin steel plate of the present disclosure may further include one or more of bainite and cementite as a structure other than the ferrite phase described above, which may be included at an area fraction of 2% or less.

In the present disclosure, in order to secure low-temperature toughness and low-temperature fatigue properties together with the strength of the thin steel plate, formation of band pearlite or bainite phase is suppressed, while air-cooled ferrite is formed to secure ductility and toughness and water-cooled ferrite is formed to secure strength and toughness.

Specifically, it is preferred that the thin steel plate of the present disclosure includes acicular ferrite having an area fraction of 30 to 50% (water-cooled ferrite) and polygonal ferrite having an area fraction of 50 to 70% (air-cooled ferrite).

When the fraction of the water-cooled ferrite is less than 30% or the fraction of the air-cooled ferrite is more than 70%, the ductility of the steel material is excellent, while the strength at a target level may not be secured. However, when the fraction of the water-cooled ferrite is more than 50%, the strength is excessively increased, so that ductility becomes poor.

It will be described in detail later, but in undergoing the rolling and cooling process for manufacturing the thin steel plate of the present disclosure, ferrite formed after completing rolling and before starting cooling (water cooling) is air-cooled ferrite and preferably has an average crystal grain size of 20 to 35 μm. Thereafter, ferrite formed during an accelerated cooling (water cooling) process is a water-cooled ferrite having a higher hardness than the air-cooled ferrite and preferably has an average crystal grain size of 20 μm or less. Herein, the average crystal grain size is based on an equivalent circle diameter.

When the average crystal grain size of the air-cooled ferrite is more than 35 μm or the average crystal grain size of the water-cooled ferrite is more than 20 μm, strength and toughness are deteriorated due to coarse crystal grains.

In the present disclosure, an appropriate fraction and a crystal grain size of the air-cooled ferrite and the water-cooled ferrite may be determined by a cooling process after rolling.

Specifically, in the present disclosure, water cooling is started at a specific temperature after rolling, and when the temperature at which the water cooling is started is high, the air-cooled ferrite phase at the appropriate fraction may not be secured, and when the temperature at which the water cooling is started is low, the crystal grain size of the air-cooled ferrite is coarsened, so that the physical properties at the target level may not be secured.

Therefore, under the process conditions to form the air-cooled ferrite and the water-cooled ferrite at the appropriate fractions, the average crystal grain size of each phase is formed as described above, thereby advantageously securing the targeted physical properties.

The thin steel plate of the present disclosure has a thickness of 8 to 30 mm, preferably 8 to 15 mm, and the microstructure described above may be formed in the entire thickness without division of region by thickness direction.

The thin steel plate of the present disclosure having a microstructure together with the alloy component system described above has a yield strength of 460 MPa or more and an elongation of 17% or more so that it has excellent strength and ductility, and an impact toughness at −40° C. of 50 J or more and a CTOD value at −20° C. of 0.4 mm or more so that it has excellent low-temperature toughness and low-temperature fatigue properties.

Hereinafter, a manufacturing method of the thin steel plate having excellent low-temperature toughness and CTOD properties according to another aspect of the present disclosure will be described in detail.

The thin steel plate intended in the present disclosure may be manufactured by preparing a steel slab satisfying the alloy component system suggested in the present disclosure, and then subjecting the steel slab to processes [heating—hot rolling (rough rolling and finish rolling)—cooling].

Hereinafter, each process conditions will be described in detail.

Steel Slab Heating

In the present disclosure, it is preferred that a steel slab is heated to perform a homogenization treatment before performing hot rolling, in which the heating process may be performed at a temperature of 1200° C. or higher.

When the heating temperature of the steel slab is lower than 1200° C., a temperature drop is increased during subsequent rolling, so that it is difficult to finish the rolling process in a single phase region. In addition, precipitates are not sufficiently solid-solubilized again, so that strength may be reduced.

Meanwhile, when the heating temperature is higher than 1300° C., coarse crystal grains may be formed and partial solubilization may occur, and thus, the heating may be performed at 1300° C. or lower.

Hot Rolling

The heated slab may be hot-rolled to manufacture a hot-rolled steel plate.

First, it is preferred that the heated slab is roughly rolled at 1000° C. or higher, that is, rolled in a recrystallization region to completely recrystallize austenite.

At this time, 2 passes at the rear end may be performed at a reduction rate of 15-20%, respectively, to suppress austenite growth and obtain crystal grain refinement effect.

According to the above, rough rolling is completed, and then finish rolling (finish hot rolling) at a temperature equivalent to or higher than Ar3, preferably in a temperature range of 850 to 900° C., that is, rolling in a non-crystallization region may be performed to obtain a hot-rolled steel plate at the target thickness.

At the time of the finish rolling, when the temperature is lower than 850° C. or lower, cooling is excessively performed while moving to a cooling zone for the subsequent cooling process, so that the hot rolled sheet temperature may be significantly lowered, and in this case, coarse air-cooled ferrite is excessively formed, so that it becomes difficult to secure target strength. However, when the temperature is higher than 900° C., crystal grains are coarsened, so that strength and toughness may become poor.

At the time of the finish rolling, rolling is performed at a cumulative reduction ratio (total reduction ratio) of 70 to 90%, thereby obtaining a hot-rolled steel plate having a thickness of 8 to 30 mm, preferably 8 to 15 mm.

Cooling

The hot-rolled steel plate obtained as described above may be cooled to manufacture the thin steel plate having the physical properties intended in the present disclosure.

In particular, in the present disclosure, it is preferred that the hot-rolled steel plate is air-cooled to a specific temperature range before water-cooling, and then water cooling is started in the temperature range.

More preferably, the hot-rolled steel plate is started to cool at a temperature equivalent to or lower than Ar3, air-cooled to a temperature range of 660 to 690° C., and then water-cooled from the temperature range to a temperature range of 550 to 590° C. at a cooling rate of 10 to 30° C./s.

The air cooling may be performed until the air-cooled ferrite having a target fraction is formed, and thus, the time is not particularly limited. For example, the air cooling may be performed at a cooling rate of 0.5 to 1.5° C./s for several seconds. Here, the cooling rate of a hot-rolled steel plate having a thickness of 15 mm or more and 30 mm or less may be lower than the cooling rate of a hot-rolled steel plate having a thickness of 8 mm or more and less than 15 mm.

Meanwhile, when the temperature at which the water cooling is started is lower than 660° C., water-cooled ferrite (acicular ferrite) may not be formed at a sufficient fraction during the water cooling, and when the temperature is higher than 690° C., the fraction of the air-cooled ferrite becomes excessive, so that strength and ductility at a target level may not be secured.

In addition, when the temperature to end the water cooling is lower than 550° C. or the cooling rate is higher than 30° C./s, a hard phase such as bainite and MA phase is formed to decrease ductility and toughness. However, when the temperature is higher than 590° C. or the cooling rate is lower than 10° C./s, crystal grains become coarse.

According to the above description, as the intended microstructure is formed in the thin steel plate of the present disclosure which has completed the cooling process, the thin steel plate having a thickness of 8 to 30 mm may secure excellent low-temperature toughness and CTOD properties as well as strength and ductility.

Hereinafter, the present disclosure will be specifically described through the following Examples. However, it should be noted that the following Examples are only for describing the present disclosure in detail by illustration, and are not intended to limit the right scope of the present disclosure. The reason is that the right scope of the present disclosure is determined by the matters described in the claims and able to be reasonably inferred therefrom.

MODE FOR INVENTION

Examples

Steel slabs having the alloy composition in the following Table 1 were prepared. At this time, the contents of the alloy contents were % by weight, and the remaining includes Fe and unavoidable impurities.

The steel slabs prepared above were heated, hot-rolled (roughly rolled and finish rolled), and cooled under the conditions shown in the following Table 2 to manufacture each hot-rolled steel material. At this time, rough rolling was performed at 1000° C. or higher, and 2 passes at the rear end were performed at reduction ratios of 15% and 20%, respectively.

In addition, after finish rolling, air cooling was performed until cooling (water cooling) was started.

TABLE 1

| Steel | Alloy composition (% by weight) | | | | | | | | | | |
|---|---|---|---|---|---|---|---|---|---|---|---|
| type | C | Si | Mn | P | S | Sol. Al | Ni | Ti | Nb | Cu | N |
| A | 0.076 | 0.16 | 1.57 | 0.0078 | 0.0015 | 0.025 | 0.62 | 0.011 | 0.018 | 0.27 | 0.0042 |
| B | 0.082 | 0.18 | 1.55 | 0.0065 | 0.0018 | 0.024 | 0.60 | 0.012 | 0.021 | 0.26 | 0.0037 |
| C | 0.078 | 0.21 | 1.63 | 0.0082 | 0.0014 | 0.020 | 0.59 | 0.012 | 0.022 | 0.24 | 0.0038 |
| D | 0.120 | 0.25 | 1.58 | 0.0083 | 0.0021 | 0.019 | 0.61 | 0.013 | 0.024 | 0.24 | 0.0040 |
| E | 0.042 | 0.19 | 1.61 | 0.0089 | 0.0014 | 0.024 | 0.55 | 0.014 | 0.019 | 0.27 | 0.0038 |

TABLE 2

| | | | Finish rolling | | | Cooling (water cooling) | | | |
|---|---|---|---|---|---|---|---|---|---|
| Test No. | Steel type | Heating Temperature (° C.) | Starting temperature (° C.) | End temperature (° C.) | Total reduction ratio (%) | Starting temperature (° C.) | End temperature (° C.) | Speed (° C./s) | Classification |
| 1 | A | 1224 | 1006 | 884 | 80 | 676 | 568 | 18.7 | Inventive Example 1 |

TABLE 2-continued

| Test No. | Steel type | Heating Temperature (° C.) | Finish rolling: Starting temperature (° C.) | Finish rolling: End temperature (° C.) | Total reduction ratio (%) | Cooling (water cooling): Starting temperature (° C.) | Cooling (water cooling): End temperature (° C.) | Cooling (water cooling): Speed (° C./s) | Classification |
|---|---|---|---|---|---|---|---|---|---|
| 2 | B | 1234 | 998 | 878 | 83 | 665 | 579 | 22.6 | Inventive Example 2 |
| 3 | C | 1226 | 1003 | 879 | 75 | 667 | 564 | 19.8 | Inventive Example 3 |
| 4 | D | 1225 | 1012 | 881 | 83 | 681 | 568 | 20.6 | Comparative Example 1 |
| 5 | E | 1236 | 987 | 862 | 85 | 662 | 574 | 15.2 | Comparative Example 2 |
| 6 | A | 1229 | 1014 | 908 | 83 | 743 | 573 | 23.1 | Comparative Example 3 |
| 7 | B | 1232 | 991 | 867 | 78 | 671 | 562 | 38.4 | Comparative Example 4 |
| 8 | C | 1230 | 994 | 874 | 80 | 683 | 421 | 22.8 | Comparative Example 5 |
| 9 | C | 1221 | — | 881 | 79 | — | — | — | Comparative Example 6 |

(In the case of Test no. 9 of Table 2, the finish rolling start temperature was not controlled after rough rolling, and air cooling was performed at the time of cooling.)

The microstructure and the mechanical properties of each hot-rolled steel material manufactured as described above were measured, and the results are shown in the following Table 3.

For the microstructure of each hot-rolled steel material, a specimen collected at a point of ¼t (wherein t is a thickness (mm)) was observed with an optical microscope (OM), and a Charpy impact test was performed on the same specimen at −40° C. to evaluate impact toughness.

In addition, the tensile strength (TS), the yield strength (YS), and the elongation (EI) of the specimen collected in accordance with the standard of JIS no. 5 were measured using a universal tensile testing machine.

CTOD properties were measured by processing a specimen so as to have a size of [steel plate thickness (T)×(2×steel plate width (W)×(2.25W×2 steel length (L))] vertically to a rolling direction in accordance with the standard of BS 7448, inserting fatigue cracks so that a fatigue crack length was 50% of a specimen width, and performing a CTOD test at −20° C. The CTOD test was performed three times for each steel plate, and the minimum value of the three test values is shown in the following Table 3.

TABLE 3

| Classification | Thickness (mm) | Microstructure: Air-cooled ferrite: Fraction (% by area) | Microstructure: Air-cooled ferrite: Size (μm) | Microstructure: Water-cooled ferrite: Fraction (% by area) | Microstructure: Water-cooled ferrite: Size (μm) | Mechanical physical properties: Yield strength (MPa) | Mechanical physical properties: Tensile strength (MPa) | Mechanical physical properties: Elongation (%) | Mechanical physical properties: Impact toughness (J) | Mechanical physical properties: CTOD (mm) |
|---|---|---|---|---|---|---|---|---|---|---|
| Inventive Example 1 | 8 | 62 | 28 | 37 | 18 | 477 | 571 | 23 | 115 | 0.75 |
| Inventive Example 2 | 12 | 58 | 26 | 40 | 20 | 504 | 563 | 20 | 122 | 0.87 |
| Inventive Example 3 | 22 | 64 | 29 | 35 | 20 | 498 | 582 | 19 | 106 | 0.64 |
| Comparative Example 1 | 8 | 54 | 31 | 41 | 22 | 472 | 624 | 16 | 42 | 0.12 |
| Comparative Example 2 | 8 | 69 | 27 | 30 | 21 | 423 | 551 | 23 | 124 | 0.98 |
| Comparative Example 3 | 18 | 12 | 29 | 72 | 20 | 454 | 592 | 15 | 65 | 0.54 |
| Comparative Example 4 | 18 | 54 | 28 | 21 | 20 | 449 | 584 | 14 | 52 | 0.62 |
| Comparative Example 5 | 25 | 58 | 24 | 19 | 20 | 462 | 593 | 16 | 38 | 0.35 |
| Comparative Example 6 | 25 | 84 | 54 | 0 | — | 421 | 541 | 25 | 76 | 0.51 |

(In Table 3, the remainder except for the fractions of air-cooled ferrite and water-cooled ferrite phases included one or more of a MA phase and a bainite phase. However, in Comparative Example 6, a large amount of pearlite phase was formed.)

As shown in Tables 1 to 3, Inventive Examples 1 to 3 satisfying all of the alloy compositions and the manufacturing conditions suggested in the present disclosure had the yield strength of 460 MPa or more and the elongation of 17% or more, and thus, were confirmed to have targeted strength and ductility. In addition, Inventive Examples had the impact toughness at −40° C. of 100 J or more and the CTOD value at −20° C. of 0.4 mm or more, and thus, were confirmed to have excellent low-temperature toughness and low-temperature fatigue properties.

FIG. 1 shows a photograph of the structure of Inventive Example 2, from which it is confirmed that air-cooled ferrite and water-cooled ferrite were appropriately formed.

In FIG. 1, relatively coarse and spherical ferrite is air-cooled ferrite, and ferrite close to acicular ferrite may be defined as water-cooled ferrite. The strength and the toughness to be desired were secured by forming the two ferrites at an appropriate ratio.

However, Comparative Example 1 in which the C content was excessive among the alloy component system suggested in the present disclosure, had a low elongation and very poor impact toughness and CTOD properties, and Comparative Example 2 having an insignificant C content could not be secured a strength at a target level.

Meanwhile, Comparative Examples 3 to 6, in which the alloy component system satisfied the present disclosure and the manufacturing conditions are out of the scope of the present disclosure, did not satisfy the target mechanical properties.

Among them, in Comparative Example 3, since water cooling was started in a single phase region, air-cooled ferrite was not sufficiently formed, and a hard phase such as bainite and MA phases was formed so that a yield strength, ductility, and low-temperature toughness were poor.

In Comparative Example 4, since a cooling rate during water cooling was excessive, water-cooled ferrite was not sufficiently formed, and a hard phase was excessively formed, so that an elongation was poor.

In Comparative Example 5, since a cooling end temperature was very low and a hard phase was excessively formed instead of a ferrite phase, impact toughness and CTOD properties together with ductility were poor.

In Comparative Example 6 in which the thin material was manufactured by a conventional process, since only air cooling was performed during cooling after rolling, without separate water cooling, a pearlite band was formed to rapidly decrease a yield strength.

The invention claimed is:

1. A thin steel plate having excellent low-temperature toughness and CTOD properties, the thin steel plate consisting of, by weight:

0.05 to 0.1% of carbon (C), 0.05 to 0.3% of silicon (Si), 1.0 to 2.0% of manganese (Mn), 0.005 to 0.04% of aluminum (Sol. Al), 0.005 to 0.03% of niobium (Nb), 0.005 to 0.02% of titanium (Ti), 0.05 to 0.4% of copper (Cu), 0.3 to 1.0% of nickel (Ni), 0.001 to 0.008% of nitrogen (N), 0.01% or less of phosphorus (P), and 0.003% or less of sulfur(S), with a balance of Fe and other unavoidable impurities, wherein the thin steel plate includes acicular ferrite having an area fraction of 30 to 50% and polygonal ferrite having an area fraction of 50 to 70% as a microstructure, wherein the acicular ferrite has an average crystal grain size of 20 μm or less and the polygonal ferrite has an average crystal grain size of 20 to 35 μm, and wherein the thin steel plate has a thickness of 8 to 30 mm.

2. The thin steel plate having excellent low-temperature toughness and CTOD properties of claim 1, wherein the thin steel plate further includes one or more of bainite and cementite in an area fraction of 2% or less.

3. The thin steel plate having excellent low-temperature toughness and CTOD properties of claim 1, wherein the thin steel plate has a thickness of 8 to 15 mm.

4. The thin steel plate having excellent low-temperature toughness and CTOD properties of claim 1, wherein the thin steel plate has a yield strength of 460 MPa or more, an elongation of 17% or more, an impact toughness at −40° C. of 50 J or more, and a CTOD value at −20° C. of 0.4 mm or more.

* * * * *